US005886616A

United States Patent [19]

Tsunezawa et al.

[11] Patent Number: 5,886,616

[45] Date of Patent: Mar. 23, 1999

[54] HIGH-VOLTAGE VARIABLE RESISTOR UNIT

[75] Inventors: Ichiro Tsunezawa, Toyama; Kazufumi Daimon, Namerikawa; Etsuo Kamimura, Fuchu-machi, all of Japan

[73] Assignee: Hokuriku Electric Industry Co., Ltd., Toyama Pref., Japan

[21] Appl. No.: 882,121

[22] Filed: Jun. 25, 1997

[51] Int. Cl.[6] ..... H01C 10/30

[52] U.S. Cl. ..... 338/160

[58] Field of Search ..... 338/162, 174, 338/187, 188, 190

[56] References Cited

U.S. PATENT DOCUMENTS

| | | | |
|---|---|---|---|
| 2,454,816 | 11/1948 | Levy | 338/162 |
| 3,512,113 | 5/1970 | Kirkendall | 338/162 |
| 3,601,743 | 8/1971 | Mathison et al. | 338/162 |
| 3,639,878 | 2/1972 | Scheel | 338/162 |
| 3,696,318 | 10/1972 | Mack | 338/162 |
| 3,772,630 | 11/1973 | Falco | 338/162 |
| 4,344,063 | 8/1982 | Nishimoto et al. | 338/162 |
| 4,635,028 | 1/1987 | Oelsch et al. | 338/162 |
| 4,835,511 | 5/1989 | Henmi | 338/162 |
| 4,884,052 | 11/1989 | Eitoku et al. | 338/162 |
| 5,500,634 | 3/1996 | Ueda | 338/162 |
| 5,699,037 | 12/1997 | Masuda et al. | 338/162 |
| 5,721,526 | 2/1998 | Daimon et al. | 338/160 |
| 5,726,625 | 3/1998 | Hasebe et al. | 338/162 |

*Primary Examiner*—Teresa Walberg
*Assistant Examiner*—Jeffrey Pwu
*Attorney, Agent, or Firm*—Pearne, Gordon, McCoy & Granger LLP

[57] ABSTRACT

A high-voltage variable resistor unit capable of permitting a circuit board to be decreased in size and preventing interruption of output thereof. A circuit board having a resistive pattern including a plurality of variable resistance elements formed on a front surface thereof is arranged in a board receiving chamber. A terminal fitment and a slide element are so arranged that a contact point between a plate-like section of the slide element and a contact section of the terminal fitment is defined in a manner to be spaced from the front surface of the circuit board toward an operation member. A fit projection of the terminal fitment is fitted in a fit hole of the insulating casing. A silicone adhesive is applied to a board supporting rib of the insulating casing to the circuit board thereto. The adhesive is constructed so as to exhibit sufficient to prevent elastic force of the arm from being reduced to a degree of causing a failure in contact between the contact section and the supported section of the slide element when it is cured.

14 Claims, 7 Drawing Sheets

HIGH-VOLTAGE VARIABLE RESISTOR UNIT

BACKGROUND OF THE INVENTION

This invention relates to a high-voltage variable resistor unit and a high-voltage electrical component.

A circuit board conventionally used for in a high-voltage variable resistor unit which is representative of a high-voltage electrical component is typically constructed in such a manner as shown in FIG. 8. A circuit board which is generally designated at a reference numeral 101 in FIG. 8 is adapted to be used for a conventional high-voltage variable resistor unit called a focusing pack which is constructed so as to variably output a focusing voltage and a screen voltage. The circuit board 101 is formed on a front surface thereof with a resistive pattern 102, which includes an input electrode E1, a focusing voltage output electrode E2, a screen voltage output electrode E3, a ground electrode E4, a first variable resistance element VR'1 for variation of a focusing voltage, a second variable resistance element VR'2 for variation of a screen voltage, and a fixed resistance element R' for voltage drop which is called a bleeder resistance. The resistive pattern 102 further includes connection patterns CP1 and CP2 acting as connection means which are contacted with a slide element (not shown) to electrically connect the slide element to the output electrodes E1 and E2, respectively. The slide element includes a slide contact slid on the variable resistance elements VR'1 and VR'2 and a contact pivotally moved on ends CP11 and CP21 of the connection patterns CP1 and CP2.

The high-voltage variable resistor unit has a size generally determined depending on an area of the circuit board 101, of which a size is determined depending on the resistive pattern 102. In determination of the resistive pattern, a distance between each adjacent two sections of the resistive pattern 102 is determined in view of so-called pattern dielectric strength for preventing generation of discharge which is generally set to be 1 mm/1 kV. Thus, distances A and B between the variable resistance elements VR'1, VR'2 and the ends CP11, CP21 of the connection patterns CP1, CP2 are likewise regulated by the pattern dielectric strength. This requires to increase a radius of a circular arc of each of the variable resistance elements VR'1 and VR'2 depending on a magnitude of a voltage applied thereto, resulting in a failure in down-sizing of the circuit board.

SUMMARY OF THE INVENTION

The present invention has been made in view of the foregoing disadvantage of the prior art.

Accordingly, it is an object of the present invention to provide a high-voltage variable resistor unit which is capable of effectively preventing interruption of output thereof due to a contact failure while reducing an area of a circuit board.

It is another object of the present invention to provide a high-voltage variable resistor unit which is capable of permitting a terminal fitment to be firmly mounted on a board supporting rib of an insulating casing.

It is a further object of the present invention to provide a high-voltage variable resistor unit which is capable of permitting a circuit board to be firmly mounted on an insulating casing while reducing an area of the circuit board.

It is still another object of the present invention to provide a high-voltage variable resistor unit which is capable of permitting a fit projection of a terminal fitment to be readily fitted in a fit hole formed in a board supporting rib of an insulating casing, as well as positively preventing removal of the fit projection from the fit hole.

It is yet another object of the present invention to provide a high-voltage variable resistor unit which is capable of effectively preventing vibration of an arm of a terminal fitment.

It is a still further object of the present invention to provide a high-voltage electric component which is capable of effectively preventing interruption of output thereof due to a contact failure while reducing an area of a circuit board.

In accordance with the present invention, a high-voltage variable resistor unit is provided. The high-voltage variable resistor unit generally includes a circuit board formed on a front surface thereof with a resistive pattern including at least one variable resistance element of an arcuate shape, an insulating casing made of an insulating resin material and including a board receiving chamber in which the circuit board is received and a board supporting rib to which the circuit board is joined by means of an adhesive, an operation member including an operation shaft rotatably inserted through the insulating casing, and at least one slide element arranged between the circuit board and a portion of the operation member positioned in the insulating casing and including a supported section supported on the operation member. The slide element is slid on the variable resistance element when the operation member is operated. The high-voltage variable resistor unit also includes at least one terminal fitment including a contact section contacted with the supported section of the slide element so as to permit pivotal movement of the slide element, a terminal section and a contact support section for connecting the contact section and terminal section to each other and electrically connected to the slide element. The terminal fitment generally acts as an output terminal fitment. Alternatively, it may serve as an input terminal fitment depending on a construction of a circuit.

The conventional high-voltage variable resistor unit, as described above, includes the connection pattern formed on the front surface of the circuit board so as to act as the connection means for electrically connecting the output electrodes and slide element to each other. Thus, the conventional high-voltage variable resistor unit is so constructed that a contact point between the connection means and the slide element is defined on the front surface of the circuit board. On the contrary, in the present invention, such a connection means is constituted by the terminal fitment. To this end, in the present invention, the slide element, as described above, is provided with the supported section supported on the operation member. The terminal fitment includes the contact section contacted with the supported section of the slide element so as to permit pivotal movement of the slide element, the terminal section and the contact support section for connecting the contact section and terminal section to each other and electrically connected to the slide element. Also, the terminal fitment and slide element are so arranged that the slide element is contacted with the contact section of the terminal fitment at a contact point spaced from the front surface of the circuit board toward the operation member or positioned apart from the front surface of the circuit board and that an end of the terminal section of the terminal fitment on a side of the terminal section is positioned apart from a center of the arcuate variable resistance element and a region between the center and the variable resistance element.

From a viewpoint of a design, the terminal fitment, particularly, the contact support section and the slide element would be generally constructed so that a maximum potential difference between the terminal fitment and slide element and the variable resistance element is reduced as compared with a discharge generation potential difference. In this regard, the above-described construction of the present invention eliminates a necessity of arranging the contact point between the terminal fitment or connection means and the slide element on a central portion of the variable resistance element as in the prior art, to thereby substantially reduce a radius of curvature of the variable resistance element as compared with the prior art. This permits the resistive pattern formed on the front surface of the circuit board to be down-sized, leading to down-sizing of the high-voltage variable resistor unit.

The contact support section of the terminal fitment functions to force the contact section against the supported section of the slide element and position the terminal fitment on the board supporting rib. For this purpose, the contact support section of the terminal fitment includes an arm provided on a distal end thereof with the contact section and arranged so as to exhibit elastic force required for forcing the contact section against the supported section of the slide element and an intermediate portion positioned between the terminal section and the arm and interposed between the board supporting rib and the circuit board. The contact support section may include a fit projection fitted in a fit hole formed in the board supporting rib depending on the structure of the terminal fitment. The intermediate portion may be preferably constructed of an extension arranged so as to extend along a side surface of the insulating casing defining the board receiving chamber and a connection for connecting the fit projection and extension to each other. In this instance, the board supporting rib may be formed with a groove in which the connection of the contact support section is fitted, to thereby ensure smooth joining of the circuit board to the insulating casing.

The terminal section of the terminal fitment may be constructed into a structure which permits a lead wire to be connected thereto by soldering or a structure which permits a lead wire or a pin-like terminal inserted thereinto to be interposedly held. Alternatively, it may be constructed into a snap-in structure which is provided with a holding element biting into an outer periphery of a pin-like terminal inserted thereinto or the like when drawing force is applied to the pin-like terminal. Thus, it will be noted that the terminal section may be constructed into any desired structure. Therefore, the above-described construction of the present invention that the contact support section is integrally provided with the terminal section reduces the number of parts required, as well as the number of steps required in manufacturing of the resistor unit. The terminal section may be arranged on a side of a rear surface of the circuit board. Alternatively, it may be arranged on a side of the front surface of the circuit board or in the insulating casing.

In particular, the terminal fitment may be arranged in such a manner that the contact support section of the terminal fitment traverses the variable resistance element while being upwardly spaced from the variable resistance element or that an output section thereof is positioned outside a circular arc of the arcuate variable resistance element in a radial direction thereof and the contact support section traverses the variable resistance element while being upwardly spaced from the variable resistance element. Such arrangement leads to further down-sizing of the high-voltage variable resistor unit. An interval between the contact support section and the variable resistance element is set to be a size sufficient to prevent discharge therebetween. This significantly reduces a space for arrangement of the variable resistance section on the circuit board including a space for arrangement of both the variable resistance element and a positioning section of the terminal fitment. Supposing that a distance required to be provided between the positioning section of the terminal fitment and the variable resistance element is represented by L and a radius of the circular arc of the variable resistance element is represented by r, positioning of the output section of the terminal fitment on an inside of the variable resistance element in the radial direction thereof causes a length of the longest portion of the space for arrangement of the variable resistance element to be as large as L+r or more. On the contrary, when the terminal fitment is arranged so as to traverse the variable resistance element while being upwardly spaced from the variable resistance element as in the present invention, a length of the longest portion of the space may be reduced to a level as small as at least L. This permits the whole space for arrangement of the variable resistance element to be further reduced, resulting in a length of the circuit board and a width thereof being substantially reduced.

In the present invention, the circuit board is joined to the board supporting rib by means of an adhesive. The adhesive may be constructed so as to exhibit elasticity sufficient to permit the elastic force of the arm to ensure electrical contact between the contact section and the supported section after it is cured. More specifically, the adhesive for joining the circuit board to the board supporting rib and the connection fitted in the groove is constructed so as to exhibit elasticity sufficient to prevent the elastic force of the arm from being substantially reduced when it flows along the extension of the terminal fitment to at least a position between a part of the extension and the side surface of the insulating casing and then is cured. Alternatively, the adhesive may be constructed so as to exhibit elasticity sufficient to prevent the elastic force of the arm from being reduced to a degree of causing a failure in contact between the contact section and the supported section of the slide element when it is cured to join a part of the extension of the terminal fitment or both the extension and a proximal portion of the arm to the side surface of the insulating casing defining the board receiving chamber. For example, a silicone adhesive may be used for this purpose.

In the conventional high-voltage electric component or high-voltage variable resistor unit, an epoxy adhesive is typically used for joining the circuit board to the board supporting rib of the insulating casing in view of its satisfactory performance, easy handling properties and reduced cost. Thus, the inventors initially considered use of an epoxy adhesive in a unit in which a terminal fitment including an arm is incorporated. Unfortunately, it was found that use of an epoxy adhesive therefor causes output of the unit to be interrupted during rotation of the slide element. As a result of disassembling of the unit, it was found that this is due to a deterioration in elasticity of the arm of the terminal fitment. Also, it was found that the deterioration is due to the adhesive for joining the circuit board to the board supporting rib.

In the present invention, application of the adhesive is carried out by arranging the insulating casing on a jig while keeping an opening of the insulating casing upwardly facing or the board supporting rib upwardly facing. Then, the operation member, slide element and terminal fitment are positioned in the insulating casing and then the adhesive is applied to the board supporting rib of the insulating casing, followed by pressing of the circuit board against the board supporting rib. During application of the adhesive and pressing of the circuit board against the board supporting rib, it may possibly flow down along the contact support section of the terminal fitment and particularly the connection of the intermediate portion. Then, the adhesive often flows through the contact support section to the proximal portion of the arm in the worst case. Thus, it was found that if an epoxy adhesive is used for this purpose, the subsequent curing causes a failure in smooth movement of the arm, to thereby deteriorate elasticity of the arm. FIG. 7 shows the arm deteriorated to the worst level, wherein an adhesive 17 flows along an inner surface of an insulating casing 2 to a connection 8*e* of a terminal fitment and a proximal portion of an arm 8*g* thereof. Such conditions cause elasticity of the arm 8*g* to be substantially or fully deteriorated, resulting in contact between the arm 8*g* and a plate-like section or supported section 7*c* of a slide element 7 being deteriorated, leading to a contact failure therebetween.

Use of an adhesive for this purpose would necessarily lead to flowing of the adhesive along the terminal fitment. In view of the fact, the inventors made efforts to develop techniques of minimizing a deterioration in elastic force of the arm due to flowing of the adhesive along the terminal fitment to the arm. As a result, it was found that this may be accomplished by using an adhesive exhibiting elasticity after curing thereof as well. Also, it was found that the elasticity is merely required to be sufficient to permit elastic force of the arm to ensure electrical contact between the contact section and the supported section. Thus, the adhesive still exhibits elasticity after the curing as well while being adhered to the connection of the terminal fitment and the proximal portion of the arm, so that smooth movement of the arm may be ensured, to thereby eliminate such output interruption as described above.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENT

Figure 1A:
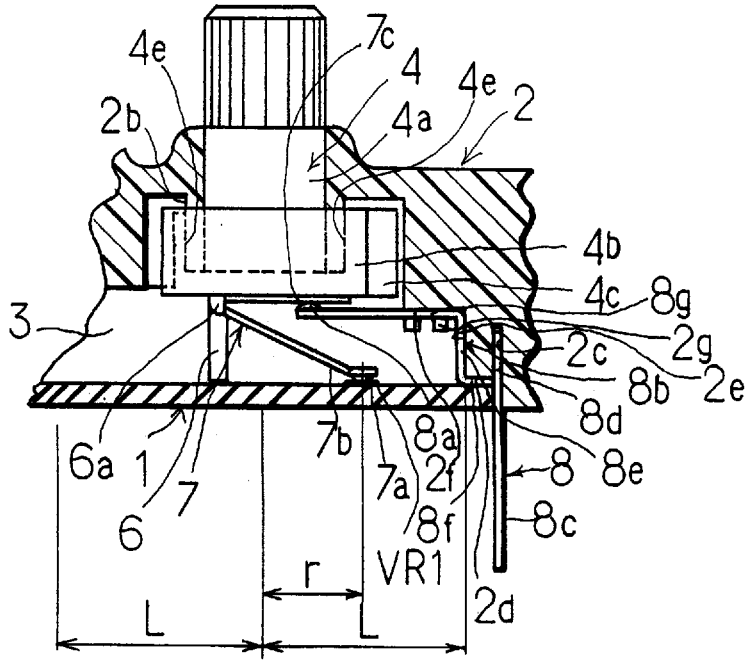
FIG. 1A is a schematic sectional view showing an essential part of a variable resistance section incorporated in an embodiment of a high-voltage variable resistor unit according to the present invention.

Now, the present invention will be described hereinafter with reference to FIGS. 1A to 7, wherein like reference numerals designate like or corresponding parts throughout.

Figure 1B:
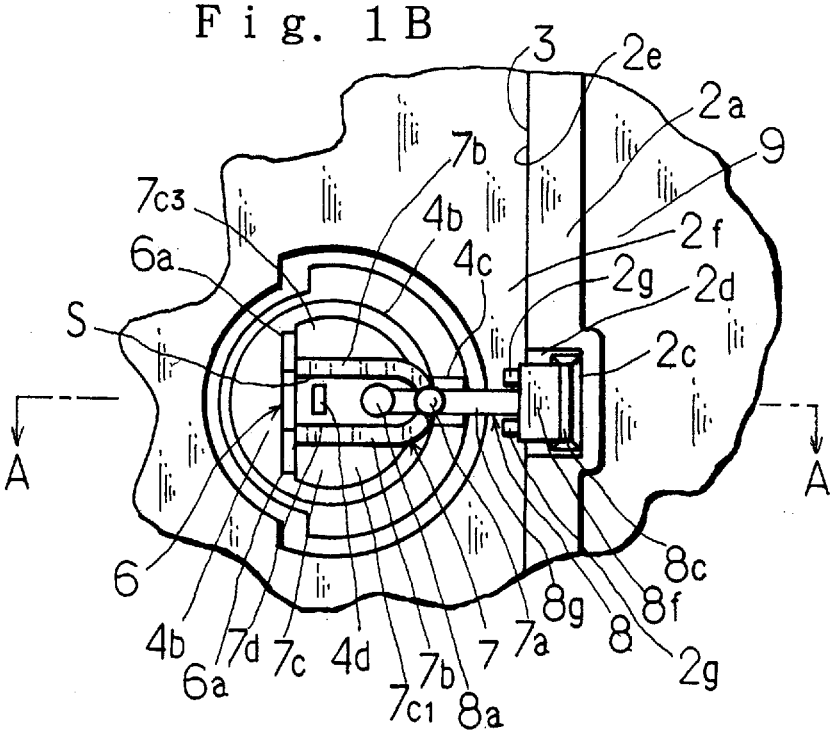
FIG. 1B is a bottom view of the part shown in FIG. 1A, wherein a circuit board is removed for the sake of brevity.

Referring first to FIGS. 1A and 1B, an essential part of a variable resistance section incorporated in an embodiment of a high-voltage variable resistor unit according to the present invention is illustrated. In the illustrated embodiment, the variable resistance section is in the form of a resistance section for varying a screen voltage. A resistance section for varying a focusing voltage likewise may be constructed in substantially the same manner. A basic structure of the essential part may be constructed in such a manner as disclosed in U.S. Ser. No. 08/579,104, now U.S. Pat. No. 5,726,625 and U.S. Ser. No. 08/683,706 now U.S. Pat. No. 5,721,526 which were filed by the assignee. More specifically, in FIGS. 1A and 1B, reference numeral 1 designates a circuit board made of a ceramic material and provided on a front surface thereof with at least one variable resistance element of an arcuate shape and 2 is an insulating casing made of an insulating resin material and formed at one end thereof with an opening. The insulating casing 2 has a board receiving chamber 3 defined therein. The circuit board 1 is joined at a part thereof to a board supporting rib 2*a* formed on a circumference of the board receiving chamber 3 of the insulating casing 2 by means of an adhesive. In the illustrated embodiment, a silicone adhesive which still exhibits elasticity after curing thereof as well may be used for this purpose. This will be detailedly described hereinafter.

Figure 2A:
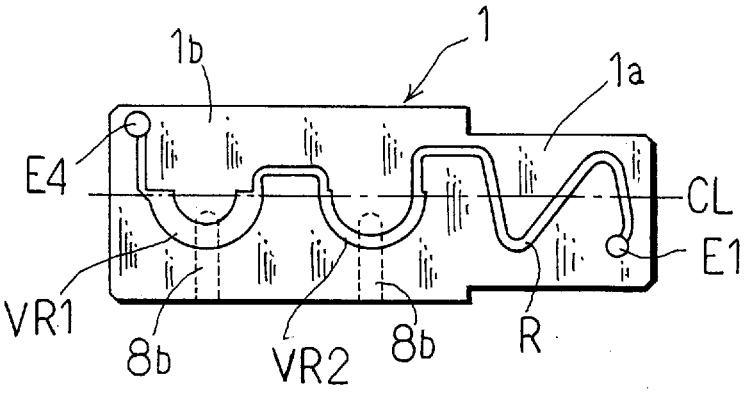
FIG. 2A is a plan view showing a circuit board which may be incorporated in an embodiment of a high-voltage variable resistor unit according to the present invention.
Figure 2B:
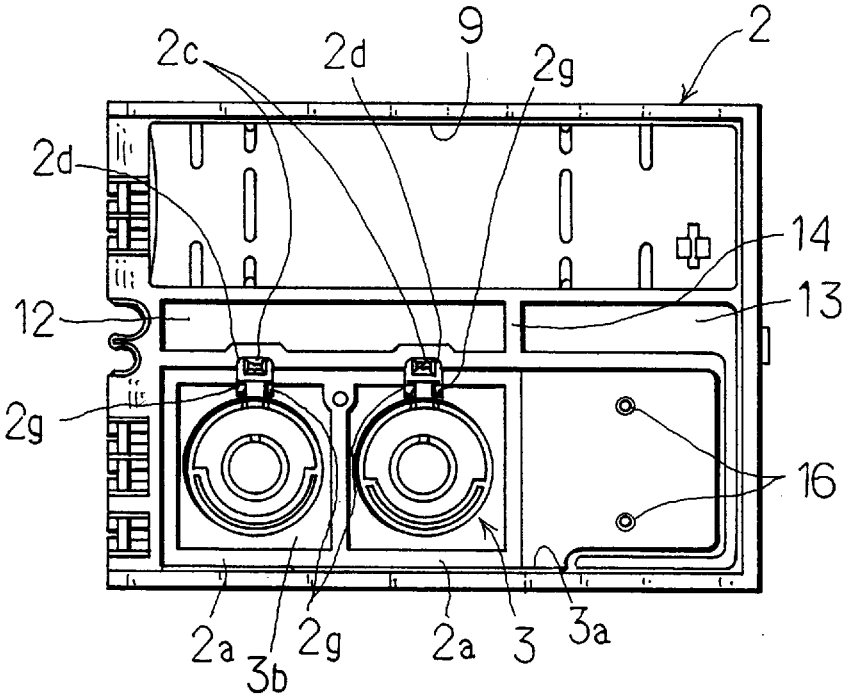
FIG. 2B is a bottom view showing an insulating casing in which the circuit board shown in FIG. 2A may be received.

The circuit board 1 is formed on the front surface thereof with such a resistive pattern as shown in FIG. 2A. The insulating casing 2 in which the circuit board 1 is received is constructed in such a manner as shown in FIG. 2B. In the illustrated embodiment, the insulating casing 2 is adapted to receive therein the circuit board 1, as well as a capacitor (not shown). The resistive pattern shown in FIG. 2A includes an input electrode E1, a ground electrode E4, a first variable resistance element VR1 for varying a screen voltage, a second variable resistance element VR2 for varying a focusing voltage, and a fixed resistance element R acting as a bleeder resistance for dropping a voltage applied to each of the variable resistance elements.

Figure 3A:
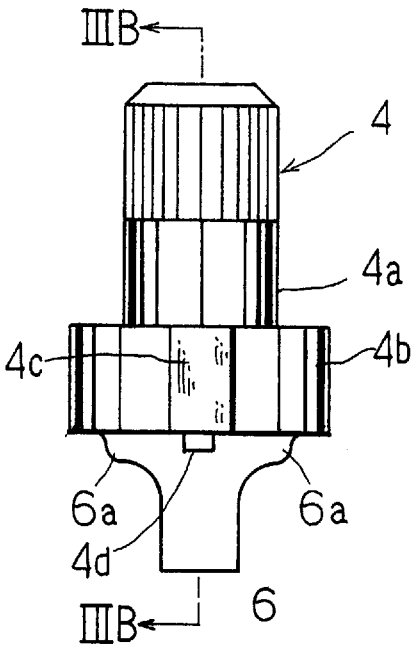
FIG. 3A is a front elevation view showing an operation member which may be incorporated in an embodiment of a high-voltage variable resistor unit according to the present invention.
Figure 3B:
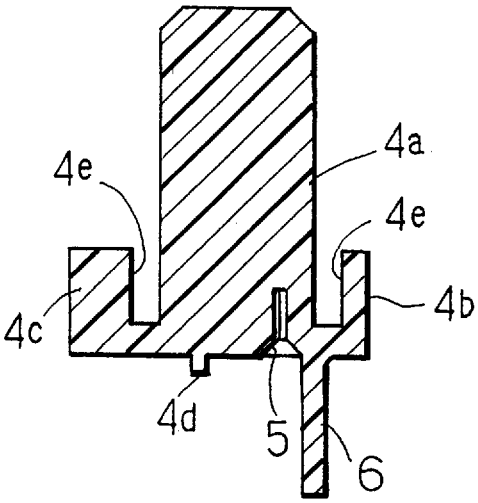
FIG. 3B is a sectional view taken along line IIIB—IIIB of FIG. 3A.
Figure 3C:
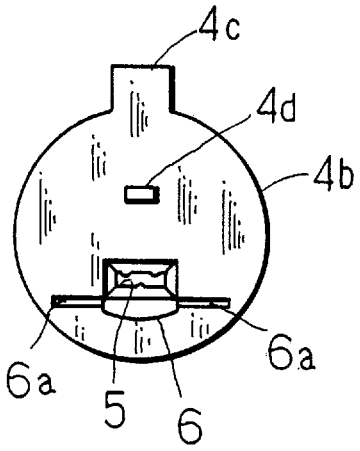
FIG. 3C is a bottom view of the operation member shown in FIG. 3A.

Reference numeral 4 (FIGS. 1A and 1B) designates at least one operation member, which includes an operation shaft section 4*a* adapted to be inserted through an upper wall of the insulating casing 2, a slide element positioning section 4*b* of an increased diameter formed integrally with the operation shaft section 4*a* and arranged in the board receiving chamber 3, and a stopper section 4*c*. The operation member 4 may be integrally formed of an insulating resin material and constructed as shown in FIGS. 3A to 3C. The slide element positioning section 4*b* of the operation member 4 is provided on an end surface thereof facing the circuit board 1 with a vertical hole 5 and a spacer 6. The spacer 6 is arranged on a portion of the operation member 4 deviated from an axis of the operation member 4. The spacer 6 thus arranged functions to regulate movement of the operation member 4 toward the circuit board 1, to thereby keep a slide element 7 from being excessively compressed during actuation of the operation member 4. The vertical hole 5 is fitted therein with a raised portion 7*e* (FIGS. 4A to 4C) of the slide element 7, to thereby prevent turning of the slide element 7. In the illustrated embodiment, the vertical hole 5, spacer 6 and stopper 4*c* are arranged in a row in a diametric direction of the operation member 4. The spacer 6 is integrally formed at a proximal portion thereof with two projections 6*a* for engagement. The engagement projections 6*a* are arranged in a manner to be spaced from each other and positioned on both sides of the vertical hole 5.

The slide element positioning section 4*b* of the operation member 4 is integrally formed on the above-described end surface thereof facing the circuit board 1 with a projection 4*d,* which is fitted in a fit hole 7*d* (FIGS. 4A to 4C) formed in the slide element 7. The projection 4*d* functions to prevent turning of the slide element 7 and position it. The slide element positioning section 4*b* of the operation member 4 is also formed with an annular fit groove 4*e* which is arranged so as to be upwardly open and surround the operation shaft section 4*a.* The fit groove 4*e* is fitted therein with a cylindrical portion 2*b* formed on an inner surface of the insulating casing 2. The cylindrical portion 2*b* is loosely fitted in the fit groove 4*e* so as to permit the operation member 4 to be rotatable.

Figure 4A:
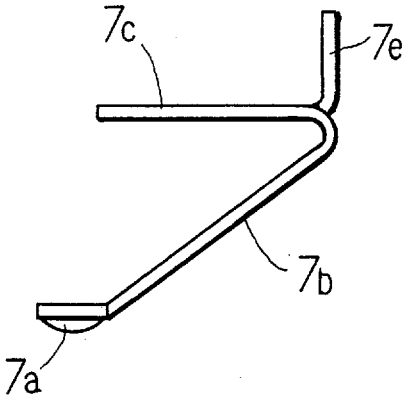
FIGS. 4A, 4B and 4C are a side elevation view, a bottom view and a front elevation view each showing a slide element which may be incorporated in an embodiment of a high-voltage variable resistor unit according to the present invention.
Figure 4B:
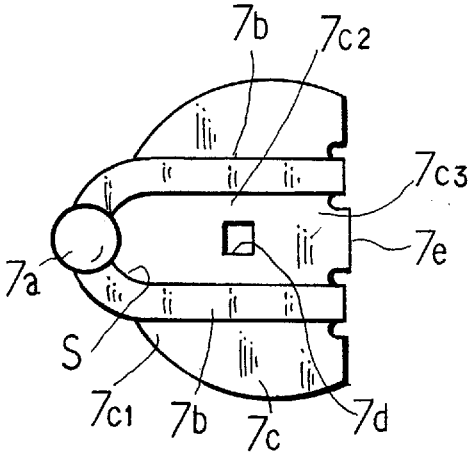
Figure 4C:
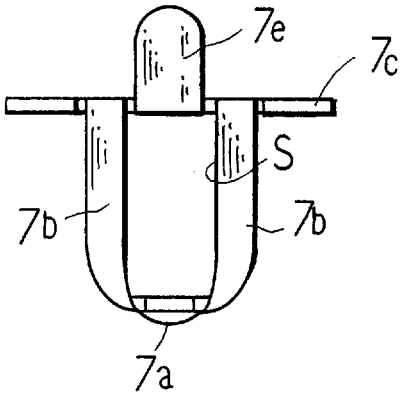

The slide element 7, as shown in FIGS. 4A to 4C, is formed by subjecting a sheet of metal such as stainless steel, phosphor bronze or the like to machining such as pressing, bending or the like. The slide element 7 includes an arm section 7*b* provided at a distal end thereof with a slide contact 7*a* adapted to be slid on each of the variable resistance elements, as well as a plate-like section or supported section 7*c* arranged so as to extend along the end surface of the slide element positioning section 4*b.* The plate-like section 7*c* includes a slide portion 7*c*1 on which a contact section 8*a* of at least one output terminal fitment 8 constituting a connection means as described hereinafter is slid, a hole formation portion 7*c*2 at which the fit hole 7*d* through which the projection 4*d* is inserted is formed, and a mounting portion 7*c*3 arranged opposite to the slide portion 7*c*1 with the fit-on hole being interposed therebetween. The above-described raised section 7*e* which is fitted in the vertical hole 5 (FIG. 3) formed in the end of the operation member 4 is arranged so as to extend in a direction substantially perpendicular to the plate-like section 7*c* or a direction toward the operation member 4 from the mounting portion 7*c*3. The arm section 7*b* has a fixed end fixed on the mounting portion 7*c*3 and a free end extending toward the slide portion 7*c*1. Also, the arm section 7*b* is formed with a slit S for adjusting elasticity of the arm section 7*b.* The mounting portion 7*c*3 is engaged at edges thereof positioned on both sides of the arm section 7*b* with the above-described engagement projections 6*a.* The raised section 7*e* is fitted in the vertical hole 5 (FIG. 3) formed in the end of the operation member 4, the projection 4*d* of the operation member 4 is inserted through the fit hole 7*d* formed in the plate-like section 7*c,* and then the mounting portion 7*c*3 is engaged at the edges thereof with the engagement projections 6*a;* so that the slide element 7 is mounted with respect to the operation member 4 while being kept from being removed therefrom. Thus, the slide element 7 is previously mounted on the operation member 4 for assembling of the high-voltage variable resistor unit, resulting the assembling being facilitated. Such construction effectively prevents vibration or shaking of the slide element 7 after the assembling.

In the illustrated embodiment, the terminal fitment 8 which constitutes the connection means functions as an output terminal fitment. The terminal fitment 8 may be made in substantially the same manner as the slide element 7. Thus, it may be formed of a sheet of metal such as stainless steel, phosphor bronze or the like by machining such as pressing, bending or the like. The terminal fitment 8 may be constructed in such a manner as shown in FIGS. 5A to 5D, wherein solid lines indicate the terminal fitment 8 which has been mounted on the insulating casing 1. The terminal fitment 8, as shown in FIGS. 5A to 5D, includes the above-described contact section 8*a* contacted with the plate-like section 7*c* of the slide element 7, a contact support section 8*b* for supporting the contact section 8*a* on one end thereof and a terminal section 8*c* connected to the other end of the contact support section 8*b.* The contact support section 8*b* includes a fit projection 8*d* fitted in a fit hole 2*c* formed in the board supporting rib 2*a,* an extension 8*e* arranged so as to extend along a side wall surface of the insulating casing 2 defining the board receiving chamber 3, a connection 8*f* for connection the fit projection 8*d* and extension 8*e* to each other therethrough, an arm 8*g* provided on a distal end thereof with the contact section 8*a* and functioning to force the contact section 8*a* against the plate-like section 7*c* of the slide element 7. In the illustrated embodiment, the connection 8*f* and extension 8*e* cooperate with each other to provide an intermediate section or portion interposed between the board supporting rib 2*a* of the insulating casing 2 and the circuit board 1 or mounted on the board supporting rib 2*a.*

Figure 5A:
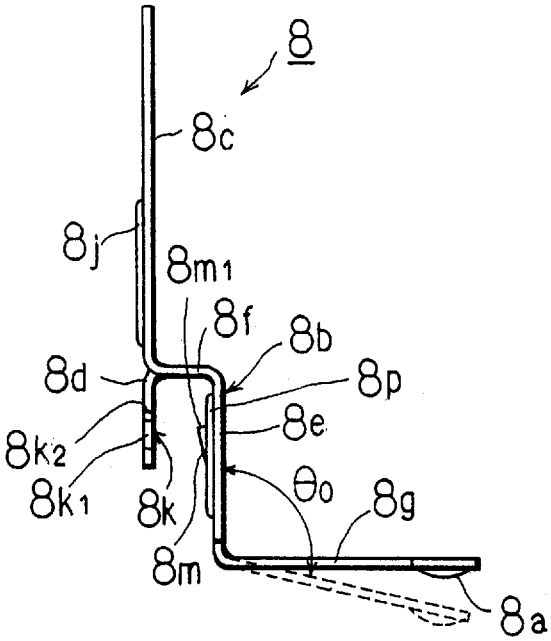
FIGS. 5A, 5B and 5C are a front elevation view, a left side elevation view and a right side elevation view each showing a terminal fitment which may be incorporated in an embodiment of a high-voltage variable resistor unit according to the present invention.
Figure 5B:
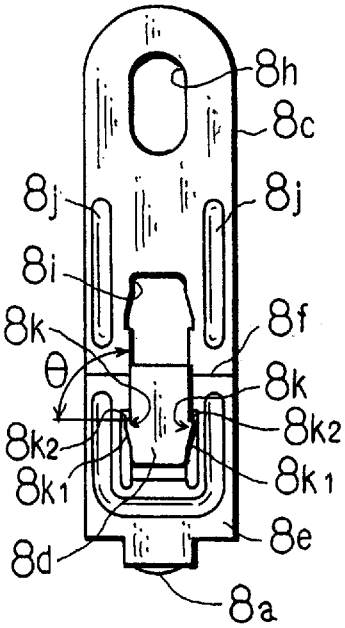
Figure 5C:
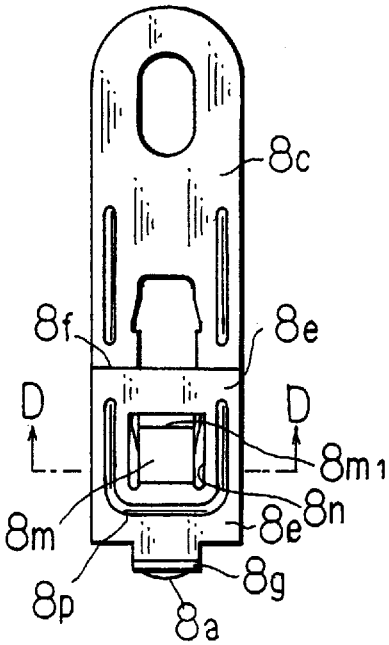
Figure 5D:
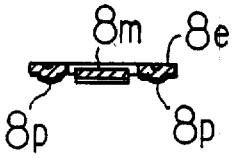
FIG. 5D is a sectional view taken along line D—D of FIG. 5C.

The terminal 8*c,* as shown in FIG. 5A, is formed at one end or free end thereof with a hole 8*h* of an elliptic shape and at the other end with a hole 8*i* for raising the fit projection 8*d.* Also, the terminal 8*c* is formed with two embossed projections 8*j* in a manner to be positioned on both sides of the hole 8*i,* resulting in being increased in mechanical strength thereof. The fit projection 8*d* of a shape like a flat plate which is formed by raising a part of the terminal 8*c* is arranged so as to extend in a direction opposite to that in which the terminal 8*c* extends. The fit projection 8*d* has a pair of edges defined in a width direction thereof rather than a thickness direction thereof (a direction of extension of the fit projection 8*d* or a direction perpendicular to a longitudinal direction of the fit projection 8*d*). The fit projection 8*d* is provided with a pair of projections 8*k,* which are projected outwardly in the width direction from the edges of the fit projection 8*d,* respectively. The projections 8*k* each include a tapered portion 8*k*1 formed so as to be increased in width as it rearwardly recedes from a distal end of the fit projection 8*d* fitted in the fit hole 2*e* and an angular portion 8*k*2 for biting which is arranged rearwardly of the tapered portion 8*k*1 based on the distal end of the fit projection 8*d.* In the illustrated embodiment, a straight portion of a slight length which is not tapered is provided between the tapered portion 8*k*1 and the biting angular portion 8*k*2. The straight portion contributes to an increase in strength of the biting angular portion 8*k*2. In the illustrated embodiment, the biting angular portion 8*k*2 has an angle θ set to be about 90 degrees. The angle θ may be suitably set to be 90 degrees or less. An angle of the tapered portion 8*k*1 and a length thereof, as well as a size of the biting angular portion 8k2 and an angle thereof may be set so as to permit the portions 8k1 and 8k2 to exhibit appropriate functions. More particularly, the tapered portion 8k1 of each of the projections 8k in one pair is required to function to partially expand the fit hole 2c of the insulating casing 2 to deform it when the fit projection 8d is inserted into the fit hole 2c. Then, when the fit hole 2c is to be returned to the original configuration after insertion of the fit projection 8d in the fit hole 2c, force is applied to the tapered portion 8k1 in a direction of forcing the fit projection 8d out of the fit hole 2c, resulting in the biting angular portion 8k2 biting into a surface of the board supporting rib 2a defining the fit hole 2c or a surface of the fit hole 2c. Such an action effectively prevents the fit projection 8d from being dislocated from the fit hole 2c. Thus, in the illustrated embodiment, the projections 8k in one pair constitute a biting means. Alternatively, a plurality of such projections may be provided on the fit projection 8d in a manner to be positioned in order in a longitudinal direction thereof. Such arrangement of the projections 8k in one pair as in the illustrated embodiment permits the tapered portions 8k1 of the projections 8k to expand the fit hole 2c to deform it when the fit projection 8d is inserted into the fit hole 2c. Then, when the fit hole 2c is to be returned to the original configuration after such insertion of the fit projection 8d in the fit hole 2c, force is applied to each of the tapered portions 8k1 in a direction of forcing the fit projection 8d out of the fit hole 2c, resulting in the biting angular portion 8k2 biting into the surface of the board supporting rib 2a defining the fit hole 2c or the surface of the fit hole 2c. This effectively prevents the fit projection 8d from being removed or detached from the fit hole 2c.

Now, the reasons why the above-described construction of the illustrated embodiment is employed will be described hereinafter. Supposing that the fit projection 8d of the terminal fitment 8 is merely fitted in the fit hole 2c of the board supporting rib 2a to position the terminal fitment 8, there is much possibility that the fit projection 8d is removed from the fit hole 2c during manufacturing of the high-voltage variable resistor unit. Even when the fit projection 8d is tightly fitted in the fit hole 2c, there is a tendency that the fit projection 8d is gradually moved in a direction of being removed from the fit hole 2c. This would be due to the fact that force exhibited by the insulating resin material when the insulating resin material in which the fit hole 2c deformed by the fit projection 8d is formed is to be returned to the original state causes the fit projection 8d to be forced out of the fit hole 2c. When the fit projection 8d of the terminal fitment 8 is moved in the direction of being detached from the fit hole 2c, the terminal fitment 8 is caused to be detached from the board supporting rib 2a. When an adhesive is applied to the board supporting rib 2a to join the circuit board 1 to the board supporting rib 2a under such conditions, the joining is carried out while keeping the circuit board 1 inclined with respect to the board supporting rib 2a due to releasing of the terminal fitment 8 from the board supporting rib 2a. Also, this causes the terminal fitment 8 to be fixed on the board supporting rib 2a while being wrongly inclined from its normal posture. This not only fails to permit the board receiving chamber 3 to exhibit satisfactory insulating characteristics, but keeps the slide element 7 from being smoothly pivotally moved and leads to a failure in electrical connection between the slide element 7 and the terminal fitment 8, resulting in manufacturing yields of the high-voltage resistor unit being significantly deteriorated or decreased.

In view of the foregoing, the illustrated embodiment, as described above, is so constructed that the fit projection 8d of the terminal fitment 8 is integrally provided with the biting means or projections 8k which bite into the surface of the insulating casing 2 defining the fit hole 2c or the surface of the fit hole 2c to keep the fit projection 8d from being detached or removed from the fit hole 2c. Such arrangement of the biting means or projections 8k effectively prevents the fit projection 8d from being moved in a direction in which the fit projection 8d is detached from the fit hole 2c, so that the terminal fitment 8 may be positively positioned on the board supporting rib 2a while being kept at its normal posture. This leads to a substantial increase in yields of the high-voltage variable resistor unit.

The connection 8f is fitted in the groove 2d formed in the board supporting rib 2a. The groove 2d is formed into a depth sufficient to permit the connection 8f fitted in the groove 2d to be flush with a surface of the board supporting rib 2a or prevent the connection 8f from being substantially projected from the surface of the board supporting rib 2a. Such formation of the groove 2d prevents the connection 8f from interfering with joining of the circuit board 1 to the board supporting rib 2a by means of an adhesive.

The extension 8e is arranged so as to extend along a side wall surface or side surface 2e of the insulating casing 2 defining the board receiving chamber 3. In the illustrated embodiment, the extension 8e is formed with a raised portion 8m to further ensure both positioning and fixing of the terminal fitment 8. The raised portion 8m has a fixed end positioned on a side of the arm 8g and raised toward the fit projection 8d. Also, the raised portion 8m has a free end Bm1, which is adapted to bite into the side surface 2e of the board receiving chamber 3 and more specifically the side surface 2e of the insulating casing 2 defining the board receiving chamber 3 when the terminal fitment 8 is moved in a direction away from the insulating casing 2 or in a non-insertion direction opposite to the direction in which the fit projection 2d of the terminal fitment is inserted into the fit hole 2c. Such arrangement of the raised portion 8m at the extension 8e permits the board supporting rib 2a to be partially interposed between the extension 8e and the fit projection 8d and the raised portion 8m to bite into the side surface 2e of the insulating casing 2, to thereby effectively prevent movement of the terminal fitment 8. It would be considered that the extension 8e is provided with the raised portion 8m without providing the fit projection 8d with the biting means or projections 8k. Unfortunately, such construction would cause the terminal fitment 8 to be moved in the non-insertion direction when any external vibration is applied to the terminal fitment 8 during manufacturing of the high-voltage variable resistor unit. The extension 8e is formed with an embossed portion 8p for reinforcement in a manner to surround a hole 8n provided for formation of the raised portion 8m.

The arm 8g is inclined as indicated at broken lines in FIG. 5A in order to exhibit elastic force necessary for forcing the contact section 8a against the plate-like section 7c of the slide element 7. The elastic force may be set at a desired level by suitably setting an angle θ0 between the extension 8e and the arm 8g and a width of the arm 8g. Excessively reduced or insufficient elastic force causes contact between the contact section 8a and the slide element 7 to be insufficient, leading to a failure in electrical connection in the high-voltage variable resistor unit. In the illustrated embodiment, the angle θ0 between the arm 8g and the extension 8e when the contact section 8a is kept contacted with the plate-like section 7c of the slide element 7 is set to be about 90 degrees and preferably 90±2 degrees. Such setting of the angle not only minimizes abrasion of the contact section 8*a,* but ensures satisfactory contact between the contact section 8*a* and the slide element 7.

The arm 8*g* of the contact support section 8*b* of the terminal fitment 8 is arranged so as to traverse the variable resistance element VR1 while being kept upwardly spaced at an interval from the variable resistance element VR1. More specifically, the terminal fitment 8 is so arranged that the terminal section 8*c* is positioned on an outside of the arcuate variable resistance element VR1 in a radial direction thereof and the arm 8*g* passes through or traverses the variable resistance element VR1 while being upwardly spaced from the variable resistance element VR1. Thus, the contact support section 8*b* of the terminal fitment 8 is arranged so as to extend from one of edges of the circuit board 1 as indicated at broken lines in FIG. 2A.

In the illustrated embodiment, the contact support section 8*b* of the terminal fitment 8 and the arm 7*b* of the slide element 7 cooperate together to support the operation member 4. This results in the contact section 8*a* of the contact support section 8*b* of the terminal fitment 8 and the plate-like section 7*c* of the slide element 7 being contacted with each other at a contact point spaced at a predetermined distance from the front surface of the circuit board 1. Thus, in the illustrated embodiment, the contact section 8*a* of terminal fitment 8 is permitted to slide on a surface of the plate-like section 7*c* of the slide element 7 while describing a locus about an axis of the operation member 4.

The terminal fitment 8 and slide element 7 each are constructed into a configuration and dimensions which permit a maximum potential difference between the terminal fitment 8 and slide element 7 and the variable resistance elements VR1 and VR2 is decreased as compared with a discharge generation potential difference. In the illustrated embodiment, generation of the maximum potential difference possibly occurs, for example, between a position in proximity to an angular portion of the plate-like section 7*c* of the slide element 7 as shown in FIG. 1B and a minimum potential portion of the variable resistance element VR1.

The board receiving chamber 3 of the insulating casing 2 has a surface 2*f* arranged so as to be opposite to the front surface of the circuit board 1. The surface 2*f* is integrally formed thereon with a pair of projections 2*g* in a manner to be projected therefrom toward the front surface of the circuit board 1. The arm 8*g* of the contact support section 8*b* of the terminal fitment 8 is arranged or fitted at a proximal end thereof between the projections 2*g*. The projections 2*g* function to prevent the arm 8*g* from rocking in a direction toward the inner surface of the insulating casing 2. This ensures positive electrical contact between the plate-like section or supported section 7*c* of the slide element 7 and the contact section 8*a* of the terminal fitment 8.

The above-described construction significantly reduces a space necessary for arrangement of the variable resistance section on the circuit board including a space for arrangement of the variable resistance element VR1 and the terminal section 8*c* of the terminal fitment 8. More particularly, supposing that a distance which is required to be provided or defined between the terminal section 8*c* of the terminal fitment 8 and a center of the circular arc of the variable resistance element VR1 is represented by L and a radius of the circular arc of the variable resistance element VR1 is represented by r, positioning of the terminal section 8*c* of the terminal fitment 8 on an inside of the variable resistance element VR1 in a radial direction thereof causes the longest portion of the space for arrangement of the variable resistance section to have a length as large as L+r or more, as shown in FIG. 1A. On the contrary, in the illustrated embodiment, the contact support section 8*b* of the terminal fitment 8 is arranged in a manner to extend from the outside of the variable resistance element VR1 in the radial direction thereof toward an inside thereof, resulting in the radius r of the circular arc of the variable resistance element VR1 being included in the dimension L. This permits the longest portion of the space to be decreased to a level as small as at least L. Thus, it will be noted that the illustrated embodiment significantly decreases the space for arrangement of the variable resistance section on the circuit board 1, to thereby accomplish down-sizing of the circuit board 1.

Figure 6A:
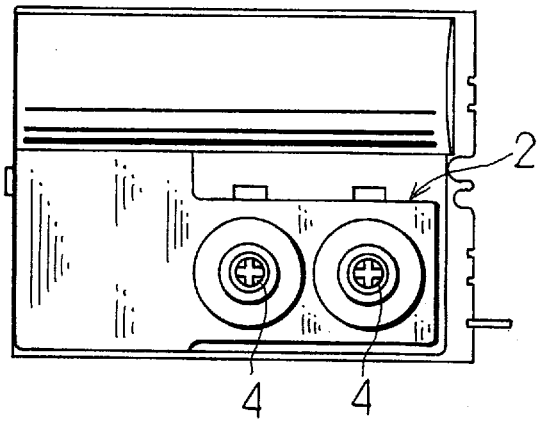
FIG. 6A, 6B and 6C are a plan view, a front elevation view and a bottom view generally showing an embodiment of a high-voltage variable resistor unit according to the present invention, respectively.
Figure 6B:
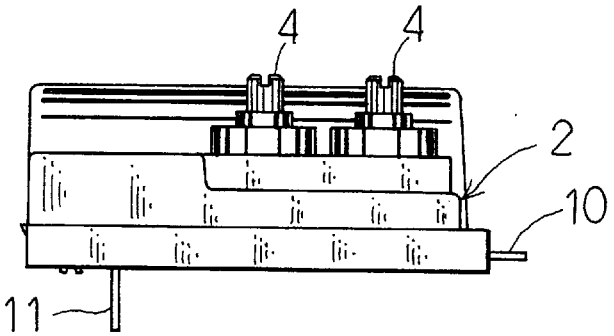
Figure 6C:
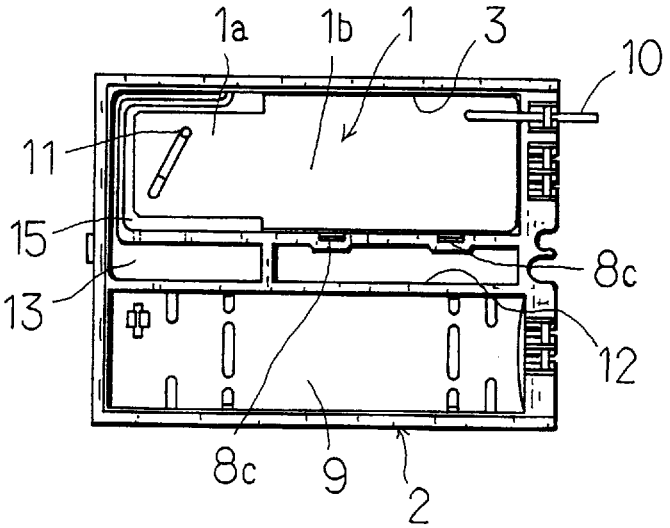
Figure 7:
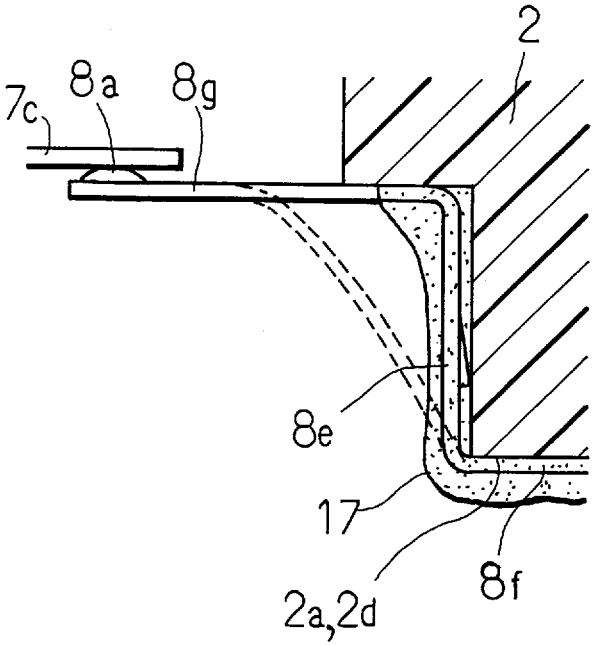
FIG. 7 is a schematic view showing pouring of an adhesive.
Figure 8:
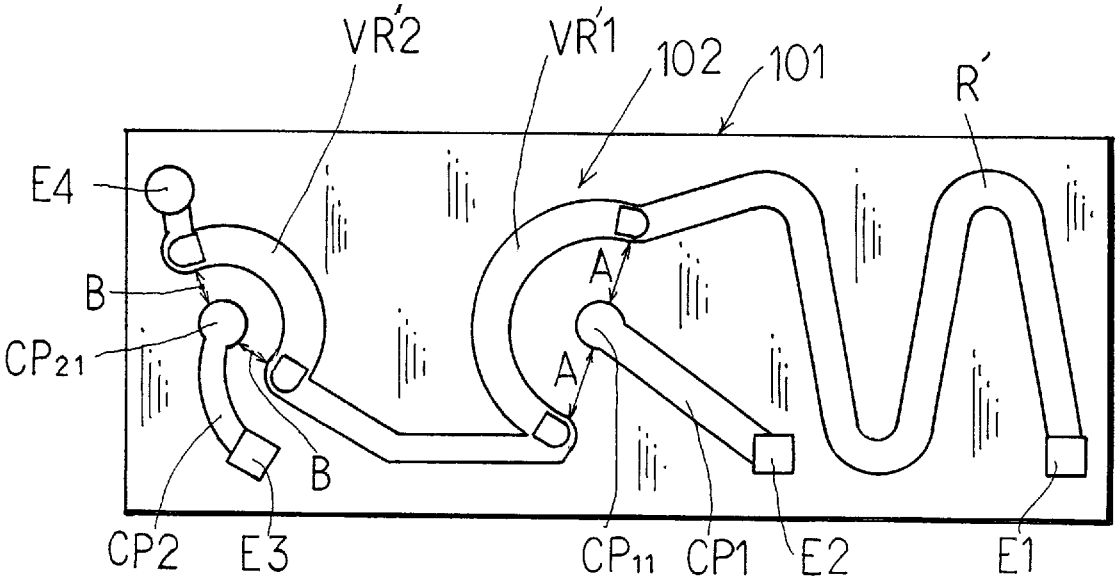
Fig. 8 Prior Art
FIG. 8 is a plan view of a circuit board incorporated in a conventional high-voltage variable resistor.

Thus, in order to minimize dimensions of the high-voltage variable resistance unit, the illustrated embodiment employs the output extracting structure shown in FIGS. 1A and 1B for each of both variable resistance elements VR1 and VR2. The high-voltage variable resistance unit of the illustrated embodiment is constructed into such a general configuration as shown in FIGS. 6*a* to 6C. In FIGS. 6A to 6C, the operation member 4 arranged on a right-handed side is for varying a screen voltage and that on a left-handed side is for varying a focusing voltage. FIG. 6C shows that the circuit board 1 has a rear surface exposed, however, the rear surface of the circuit board 1 is actually charged thereon with insulating epoxy resin. A capacitor receiving chamber 9 and the board receiving chamber 3 each are charged therein with rigid insulating epoxy resin for molding of a fly-back transformer after the insulating casing 2 is mounted on the fly-back transformer.

In FIGS. 6B and 6C, reference numeral 10 designates a ground terminal and 11 is an input terminal. The insulating casing 2 is formed with a recess 12, which is arranged so as to extend along the terminal section 8*c* of the terminal fitment 8 between the board receiving chamber 3 and the capacitor receiving chamber 9 and filled therein with insulating resin. Also, the insulating casing 2 is formed with a recess 13 in a manner to surround a section 1*a* of the circuit board 1 on a high-voltage side thereof or a side thereof on which the input terminal 11 or fixed resistance element R is arranged. The recess 13 is likewise filled therein with resin for molding the fly-back transformer.

Now, the circuit board 1 will be described hereinafter with reference to FIG. 2A. The circuit board 1, as described above, is formed on the front surface thereof with the input electrode E1 and ground electrode E4, the first arcuate variable resistance element VR1 for varying a screen voltage, the second arcuate resistance element VR2 for varying a focusing voltage, and the fixed resistance element R. The circuit board 1 is so formed that the board section la thereof on which the fixed resistance element R is formed is decreased in circumferential dimension as compared with a first board section thereof on which the variable resistance elements VR1 and VR2 are formed. This results in a slit 15 which extends along the circumference of the board portion la being formed as shown in FIG. 6C. The slit 14 acts to permit soft insulating resin to be poured therethrough into a first section 3*a* of the board receiving chamber 3 shown in FIG. 2B. The first section 3*a* of the board receiving chamber 3 is previously partially charged therein with the soft insulating resin prior to receiving of the circuit board 1 therein.

The first and second variable resistance elements VR1 and VR2 are so arranged that two arcuate openings of the variable resistance elements VR1 and VR2 are open to a side of the circuit board 1 opposite to a side thereof on which the terminal sections of the two terminal fitments 8 are arranged. Also, the first and second variable resistance elements VR1 and VR2 are arranged on the front surface of the circuit board 1 in such a manner that the center of the circular arc of each of the variable resistance elements is positioned along a virtual straight line CL defined so as to extend in a longitudinal direction of the circuit board. Such arrangement substantially reduces a width of the circuit board and a length thereof as compared with the prior art. More specifically, the illustrated embodiment permits dimensions of the circuit board 1 to be reduced to a level two third as large as the conventional one or less.

The board receiving chamber 3 of the insulating casing 2 in which the circuit board 1 is received, as shown in FIGS. 2A and 2B, includes the above-described first section 3*a* in which the board section 1*a* of the circuit board 1 is received and a second section 3*b* in which the first board section of the circuit board 1 is received. The first section 3*a* of the board receiving chamber 3 is integrally formed on an inner surface thereof with two projections 16 for supporting the board section 1*a* of the circuit board 1. Also, the second section 3*b* of the board receiving chamber 3 is provided on an inner surface thereof with the above-described board supporting rib 2*a* on which a peripheral edge of the board section 1*b* of the circuit board 1 is arranged.

Now, manufacturing or assembling of the high-voltage variable resistor unit of the illustrated embodiment will be described hereinafter. First, the insulating casing 2 is arranged on a jig while keeping the opening of the insulating casing 2 or the board supporting rib 2*a* upwardly facing. Then, the operation member 4 which is previously mounted on an end thereof with the slide element 7 is mounted on a predetermined position of the insulating casing 2. Thereafter, the board supporting rib 2*a* of the insulating casing 2 is partially interposedly supported between the fit projection 8*d* and the extension 8*e* while fitting the fit projection 8*d* of the terminal fitment 8 in the fit hole 2*c* of the insulating casing 2, resulting in the terminal fitment 8 being mounted on the insulating casing 2. At this time, the contact section 8*a* of the terminal fitment 8 is kept contacted with the plate-like section 7*c* of the slide element 7. Then, an adhesive 17 is applied onto the board supporting rib 2*a* of the insulating casing 2, followed by arrangement of the circuit board 1 on the board supporting rib 2*a*. The adhesive is left to stand for curing, to thereby join the circuit board 1 to the board supporting rib 2*a*.

In the illustrated embodiment, the adhesive 17 for joining the circuit board 1 to the board supporting rib 2*a* preferably exhibits elasticity which permits the arm 8*g* to be provided with elastic force necessary to ensure electrical contact between the contact section 8*a* and the plate-like section 7*c* of the slide element 7 after it is cured. More specifically, a silicone adhesive which exhibits Shore hardness of D10 to D40 and elongation of 150 to 250% after curing may be suitably used for this purpose. Such an adhesive prevents the arm from substantially losing elasticity even when it flows along the inner surface of the insulating casing and finally reaches the connection 8*e* and arm 8*g* of the terminal fitment 8. This prevents a deterioration in contact between the arm 8*g* and the plate-like section or supported section 7*c* of the slide element 7, to thereby ensure satisfactory contact therebetween.

Subsequently, the circuit board 1 is charged on the rear surface thereof with a soft insulating resin, followed by curing of the resin to provide an insulating resin layer. The high-voltage variable resistor unit thus manufactured may be serviceable as it is. Alternatively, it may be typically mounted on the casing of a fly-back transformer.

The operation shaft section 4*a* of the operation member 4 may be coated on an outer periphery thereof with oil such as grease. In this instance, in order to keep the oil from adhering to the slide element, it is preferable that the operation shaft section 4*a* of the operation member 4 is mounted on the insulating casing 2 and then the slide element 7 is mounted on the operation member 4.

In the illustrated embodiment, the insulating resin layer is formed on the rear surface of the circuit board 1. However, the illustrated embodiment may be suitably applied to a high-voltage variable resistor unit of the type that the opening of the board receiving chamber 3 of the insulating casing 2 is closed with a lid member without forming the insulating resin layer.

As can be seen from the foregoing, the present invention significantly decreases a space on the circuit board required for arrangement of the variable resistance section including the fixed resistance element for reducing a voltage applied to the variable resistance elements, to thereby reduce whole dimensions of the circuit board, resulting in down-sizing of the high-voltage variable resistor unit.

In particular, in the present invention, the adhesive applied for joining the circuit board to the circuit board support section of the insulating casing exhibits elasticity of a predetermined level or more after curing thereof as well; so that even when the adhesive is applied to the intermediate section of the terminal fitment such as the connection or the proximal end of the arm, it does not substantially restrain movement of the arm, to thereby eliminate interruption of output of the high-voltage variable resistor unit.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A high-voltage variable resistor unit comprising:

a circuit board formed on a front surface thereof with a resistive pattern including at least one variable resistance element of an arcuate shape;

an insulating casing made of an insulating resin material said casing defining a board receiving chamber in which said circuit board is received and including a board supporting rib to which said circuit board is joined by means of an adhesive;

an operation member including an operation shaft rotatably inserted through said insulating casing;

at least one slide element arranged between said circuit board and a portion of said operation member positioned in said insulating casing, said at least one slide element including a supported section supported on said operation member;

said slide element being slid on said at least one variable resistance element when said operation member is operated; and at least one terminal fitment including a contact section contacted with said supported section of said slide element so as to permit pivotal movement of said slide element, a terminal section and a contact support section for connecting said contact section and terminal section to each other and electrically connected to said slide element;

said terminal fitment and slide element being arranged such that said slide element is contacted with said contact section of said terminal fitment at a contact point, said contact point being spaced from said front surface of said circuit board toward said operation member, said terminal section of said terminal fitment being positioned outside said at least one variable resistance element;

said contact support section of said terminal fitment including an arm provided on a distal end thereof with said contact section and exhibiting elastic force for forcing said contact section against said supported section of said slide element and an intermediate portion positioned between said terminal section and said arm and interposed between said board supporting rib and said circuit board;

wherein said adhesive for joining said circuit board to said board supporting rib being constructed so as to exhibit elasticity sufficient to permit said elastic force of said arm to ensure electrical contact between said contact section and said supported section after said adhesive is cured.

2. A high-voltage variable resistor unit as defined in claim 1, wherein said adhesive is a silicone adhesive.

3. A high-voltage variable resistor unit as defined in claim 2, wherein said adhesive exhibits Shore hardness of D10 to D40 and elongation of 150 to 250% after it is cured.

4. A high-voltage variable resistor unit comprising:

a circuit board formed on a front surface thereof with a resistive pattern including a variable resistance element of an arcuate shape;

an insulating casing made of an insulating resin material said casing defining a board receiving chamber in which said circuit board is received and including a board supporting rib to which said circuit board is joined by means of an adhesive;

an operation member including an operation shaft rotatably inserted through said insulating casing;

a slide element arranged between said circuit board an a portion of said operation member positioned in said insulating casing and including a supported section supported on said operation member;

said slide element being slid on said variable resistance element when said operation member is operated; and a terminal fitment including a contact section contacted with said supported section of said slide element so as to permit pivotal movement of said slide element, a terminal section and a contact support section for connecting said contact section and terminal section to each other and electrically connected to said slide element;

said terminal fitment and slide element being arranged such that said slide element is contacted with said contact section of said terminal fitment at a contact point, said contact point being spaced from said front surface of said circuit board toward said operation member, said terminal section of said terminal fitment being positioned outside said arcuate variable resistance element;

said contact support section of said terminal fitment including a fit projection fitted in a fit hole formed in said board supporting rib, an extension arranged so as to extend along a side surface of said insulating casing defining said board receiving chamber, a connection for connecting said fit projection and extension to each other, and an arm provided on a distal end thereof with said contact section and exhibiting elastic force for forcing said contact section against said supported section of said slide element;

wherein said adhesive for joining said circuit board to said board supporting rib being constructed so as to exhibit elasticity sufficient to prevent said elastic force of said arm from being substantially reduced when it flows along said extension of said terminal fitment to at least a position between a part of said extension and said side surface of said insulating casing and then cured.

5. A high-voltage variable resistor unit as defined in claim 4, wherein said fit projection of said terminal fitment is integrally provided with a biting means which bites into a surface defining said fit hole to keep said fit projection from being removed from said fit hole.

6. A high-voltage variable resistor unit as defined in claim 4, wherein said fit projection is formed into a shape like a flat plate; and said biting means is constituted by a pair of projections arranged on a pair of edges of said fit projection defined in a width direction thereof in a manner to be projected therefrom outwardly in said width direction;

said projections in a pair each including a tapered portion increased in width as it recedes from a distal end of said fit projection fitted in said fit hole and a biting angular portion arranged rearwardly of said tapered portion based on said distal end.

7. A high-voltage variable resistor unit as defined in claim 4, wherein said terminal fitment is so arranged that said terminal section of said terminal fitment is positioned outside said arcuate variable resistance element in a radial direction thereof and said arm of said contact support section upwardly traverses said variable resistance element while being spaced from said variable resistance element.

8. A high-voltage variable resistor unit as defined in claim 4, wherein said extension of said terminal fitment is formed with a raised portion;

said raised portion having a fixed end positioned on a side of said arm and being raised on a side of said fit projection;

said raised portion having a free end formed into a shape which permits it to bite into said side surface of said insulating casing defining said board receiving chamber when said terminal fitment is moved in a direction away from said insulating casing.

9. A high-voltage variable resistor unit as defined in claim 4, wherein said insulating casing is integrally formed on a surface thereof opposite to said front surface of said circuit board with a pair of projections in a manner to extend toward said front surface of said circuit board; and said arm of said contact support section of said terminal fitment is fitted at a distal portion thereof between said projections.

10. A high-voltage variable resistor unit comprising:

a circuit board formed on a front surface thereof with a resistive pattern including a plurality of variable resistance elements of an arcuate shape;

an insulating casing defining a board receiving chamber in which said circuit board is received and including a board supporting rib to which said circuit board is joined;

an operation member including an operation shaft rotatably inserted through said insulating casing;

a plurality of slide elements each arranged between said circuit board and a portion of said operation member positioned in said insulating casing and including a supported section supported on said operation member;

said slide elements being slid on said variable resistance elements when said operation member is operated; and a plurality of terminal fitments each including a contact section contacted with said supported section of said slide element so as to permit pivotal movement of each of said slide elements, a terminal section and a contact support section for connecting said contact section and terminal section to each other;

said terminal fitments being electrically connected to said slide elements corresponding thereto, respectively;

each of said terminal fitments and each of said slide elements being so arranged that said supported section of said slide element is contacted with said contact section of said terminal fitment at a contact point spaced from said front surface of said circuit board toward said operation member;

said contact support section of each of said terminal fitments including a fit projection fitted in a fit hole formed in said board supporting rib, an extension arranged so as to extend along a side surface of said insulating casing defining said board receiving chamber, a connection for connecting said fit projection and extension to each other, and an arm constructed so as to exhibit elastic force for forcing said contact section against said supported section of said slide element;

said board supporting rib being formed with a groove in which said connection of said contact support section is fitted so as not to interfere with joining of said circuit board thereto;

said circuit board being joined to said board supporting rib and said connection fitted on said groove by means of an adhesive;

said adhesive being constructed so as to exhibit elasticity sufficient to prevent said elastic force of said arm from being reduced to a degree of causing a failure in contact between said contact section and said supported section of said slide element when it is cured to join a part of said extension of said terminal fitment or both said extension and a proximal portion of said arm to said side surface of said insulating casing defining said board receiving chamber.

11. A high-voltage variable resistor unit as defined in claim 10, wherein said adhesive exhibits Shore hardness of D10 to D40 and elongation of 150 to 250% after it is cured.

12. A high-voltage electrical component comprising:

a circuit board formed on a front surface thereof with a circuit pattern;

an insulating casing defining a board receiving chamber in which said circuit board is received and including a board supporting rib to which said circuit board is joined by means of an adhesive;

a conductive member arranged in said board receiving chamber and electrically connected to said circuit pattern; and a terminal fitment electrically connected to said conductive member;

said terminal fitment including a contact section contracted with said conductive member, a terminal section and a contact support section for connecting said contact section and terminal section to each other;

said contact support section of said terminal fitment including an arm provided on a distal end thereof with said contact section and exhibiting elastic force for forcing said contact section against said conductive member and an intermediate portion positioned between said terminal section and said arm and interposed between said circuit board and said board supporting rib;

wherein said adhesive for joining said circuit board to said board supporting rib being constructed so as to exhibit elasticity sufficient to permit said elastic force of said arm to ensure electrical contact between said contact section and said conductive member after it is cured.

13. A high-voltage electrical component as defined in claim 12, wherein said adhesive exhibits Shore hardness of D10 to D40 and elongation of 150 to 250% after it is cured.

14. A high-voltage electrical component comprising:

a circuit board formed on a front surface thereof with a circuit pattern;

an insulating casing made of an insulating resin material and defining a board receiving chamber in which said circuit board is received and including a board supporting rib to which said circuit board is joined by means of an adhesive;

a conductive member arranged in said board receiving chamber and electrically connected to said circuit pattern; and a terminal fitment electrically connected to said conductive member;

said terminal fitment including a contact section contacted with said conductive member, a terminal section and a contact support section for connecting said contact section and terminal section to each other;

said contact support section of said terminal fitment including a fit projection fitted in a fit hole formed in said board supporting rib, an extension arranged so as to extend along a surface of said insulating casing defining said board receiving chamber, a connection for connecting said fit projection and extension to each other, and an arm provided at a distal end thereof with said contact section and constructed so as to exhibit elastic force for forcing said contact section against said conductive member;

said board supporting rib being formed with a groove in which said connection of said contact support section is fitted so as not to interfere with joining of said circuit board thereto;

wherein said adhesive being constructed so as to exhibit elasticity sufficient to prevent said elastic force of said arm from being reduced to a degree of causing a failure in contact between said contact section and said conductive member when it is cured to join said extension of said terminal fitment or both said extension and a proximal portion of said arm to said surface of said insulating casing defining said board receiving chamber.

* * * * *

UNITED STATES PATENT AND TRADEMARK OFFICE

CERTIFICATE OF CORRECTION

PATENT NO. : 5,886,616

DATED : March 23, 1999

INVENTOR(S) : Tsunezawa et al.

It is certified that error appears in the above-indentified patent and that said Letters Patent is hereby corrected as shown below:

On the Title Page, add the priority information
--Japan 167646 6/27/96
Japan 167647 6/27/96--.

Column 10, Line 30, delete "Bml" and insert --8ml--.

Signed and Sealed this

Twenty-first Day of September, 1999

*Attest:*

Q. TODD DICKINSON

*Attesting Officer*

*Acting Commissioner of Patents and Trademarks*